US010724760B2

(12) United States Patent
Iwatsuki et al.

(10) Patent No.: US 10,724,760 B2
(45) Date of Patent: Jul. 28, 2020

(54) AIR-CONDITIONING INDOOR UNIT

(71) Applicant: Mitsubishi Electric Corporation, Tokyo (JP)

(72) Inventors: Shingo Iwatsuki, Tokyo (JP); Takahiro Iinuma, Tokyo (JP); Yoshinori Miyata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 57 days.

(21) Appl. No.: 15/774,856

(22) PCT Filed: Jan. 15, 2016

(86) PCT No.: PCT/JP2016/051115
§ 371 (c)(1),
(2) Date: May 9, 2018

(87) PCT Pub. No.: WO2017/122343
PCT Pub. Date: Jul. 20, 2017

(65) Prior Publication Data

US 2018/0328620 A1 Nov. 15, 2018

(51) Int. Cl.
*F24F 13/20* (2006.01)
*F24F 11/89* (2018.01)
(Continued)

(52) U.S. Cl.
CPC ..... *F24F 13/20* (2013.01); *F24F 11/89* (2018.01); *F24F 13/22* (2013.01); *F24F 13/222* (2013.01); *F24F 13/32* (2013.01)

(58) Field of Classification Search
CPC .. F24F 13/20; F24F 11/89; F24F 13/22; F24F 13/32; F24F 13/222
See application file for complete search history.

(56) References Cited

U.S. PATENT DOCUMENTS

2008/0104988 A1* 5/2008 Lee ..... F24F 13/222 62/285
2009/0158934 A1* 6/2009 Jang ..... F24F 13/1406 96/189

(Continued)

FOREIGN PATENT DOCUMENTS

JP H04-095218 U 8/1992
JP H07-145955 A 6/1995
JP 2003-232535 A 8/2003

OTHER PUBLICATIONS

International Search Report of the International Searching Authority dated Apr. 12, 2016 for the corresponding international application No. PCT/JP2016/051115 (and English translation).

*Primary Examiner* — Joseph F Trpisovsky
(74) *Attorney, Agent, or Firm* — Posz Law Group, PLC

(57) ABSTRACT

An air-conditioning indoor unit includes: a heat exchanger of a refrigerant circuit; a drain pan installed below the heat exchanger; a fan configured to send air to the heat exchanger; a control box containing control parts configured to control operation of the fan and other components; and a casing, in which the heat exchanger, drain pan, fan, and control box are stored in the casing, a drain pan inlet-outlet port is formed in the casing, a hinge assembly is installed on a side plate of the casing, and the control box is coupled to the casing so as to be able to be taken in and out of the drain pan inlet-outlet port of the casing. This allows the drain pan to be attached and detached to and from the casing by removing internal wiring from the control box without removing the control box from the casing.

10 Claims, 9 Drawing Sheets

(51) Int. Cl.
*F24F 13/22* (2006.01)
*F24F 13/32* (2006.01)

(56) References Cited

U.S. PATENT DOCUMENTS

2016/0003116 A1* 1/2016 Terada ..... F01N 13/1872
60/312
2017/0030595 A1* 2/2017 Choi ..... F24F 13/20

* cited by examiner

AIR-CONDITIONING INDOOR UNIT

CROSS REFERENCE TO RELATED APPLICATION

This application is a U.S. national stage application of PCT/JP2016/051115 filed on Jan. 15, 2016, the contents of which are incorporated herein by reference.

TECHNICAL FIELD

The present invention relates to an indoor unit of an air-conditioning device, the indoor unit being applied to a packaged air conditioner and the like, and more particularly, relates to a mounting structure for a control box of a ceiling concealed air-conditioning indoor unit.

BACKGROUND ART

A conventional ceiling concealed air-conditioning indoor unit includes a heat exchanger, a fan, a drain pan, and a control box as well as a casing configured to store these components. A terminal block in the control box of the air-conditioning indoor unit described above is connected with on-site wiring as well as internal wiring within the casing. In that case, the wiring is connected via a mounting bracket selectively mounted on an outer side or inner side of a side plate of the casing (e.g., Patent Literature 1).

On the other hand, with an air-conditioning indoor unit of a two-way airflow ceiling cassette type, the control box is placed on an underside of the drain pan in response to demands to increase maintainability inside the control box.

CITATION LIST

Patent Literature

Patent Literature 1: Japanese Unexamined Utility Model Application Publication No. 4-95218 (Paragraphs [0033] to [0035]; FIGS. 1 to 4)

SUMMARY OF INVENTION

Technical Problem

With the control box of the conventional ceiling cassette type two-way airflow air-conditioning indoor unit such as described above, in doing maintenance of the drain pan, the drain pan has to be removed from the casing and taken out of the casing through a drain pan inlet-outlet port. In so doing, the drain pan cannot be removed from the casing unless the on-site wiring and internal wiring are removed from the control box screw-fixed to the drain pan, which presents a problem in that detachability of the drain pan is not good.

The present invention has been made to solve the above problem and has an object to provide an air-conditioning indoor unit that allows a drain pan to be removed from a casing by simply removing internal wiring from a control box.

Solution to Problem

An air-conditioning indoor unit of an air-conditioning device according to an embodiment of the present invention includes: a heat exchanger of a refrigerant circuit; a drain pan installed below the heat exchanger; a fan configured to send air to the heat exchanger; a control box containing control parts configured to control operation of the fan and other components; and a casing, wherein the heat exchanger, the drain pan, the fan, and the control box are stored in the casing, a drain pan inlet-outlet port is formed in the casing, a hinge assembly is installed on a side plate of the casing, and the control box is coupled to the casing via the hinge assembly in such a way as to be able to be taken in and out of the drain pan inlet-outlet port of the casing.

Advantageous Effects of Invention

In the air-conditioning indoor unit according to the embodiment of the present invention, since the drain pan inlet-outlet port is formed in the casing and the hinge assembly is installed on the side plate of the casing and the control box is coupled to the casing via the hinge assembly in such a way as to be able to be taken in and out of the drain pan inlet-outlet port of the casing, the control box can be taken out of the casing by pivoting on the hinge assembly at a time of inspection and repair. That is, the control box can be taken out in a coupled state without being separated from the casing. This provides the advantage of improved detachability of the drain pan: specifically, in the operation of taking the drain pan out of the drain pan inlet-outlet port of the casing, there is no need to remove on-site wiring from the control box, and the drain pan to be removed from the casing with the control box kept coupled to the side plate of the casing by simply removing internal wiring from the control box.

DESCRIPTION OF EMBODIMENTS

Embodiment 1

Figure 1:
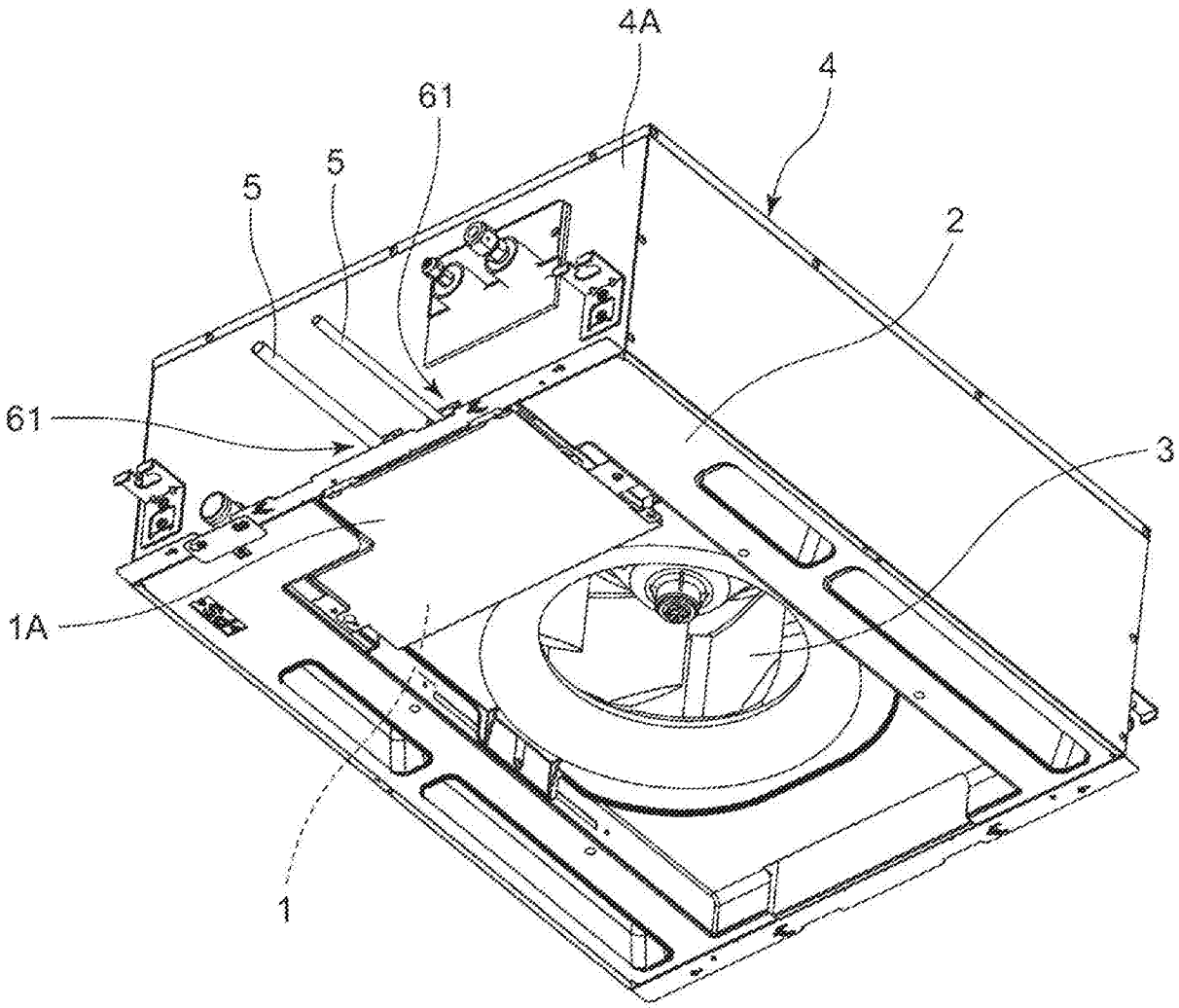
FIG. 1 is an overall external view of an air-conditioning indoor unit of an air-conditioning device according to Embodiment 1 of the present invention as viewed obliquely from below.
Figure 2:
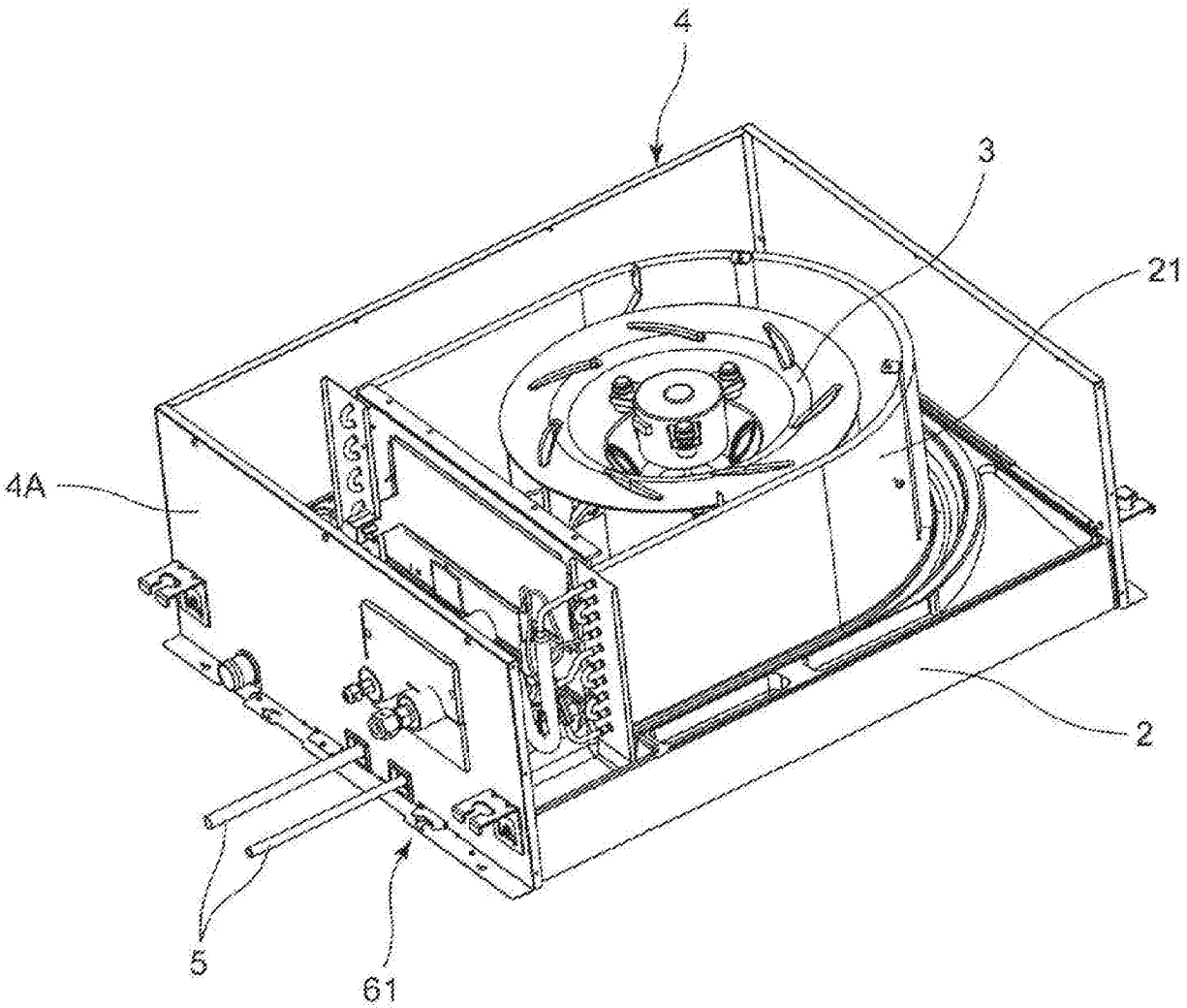
FIG. 2 is an internal structural diagram of the air-conditioning indoor unit as viewed obliquely from above.
Figure 3:
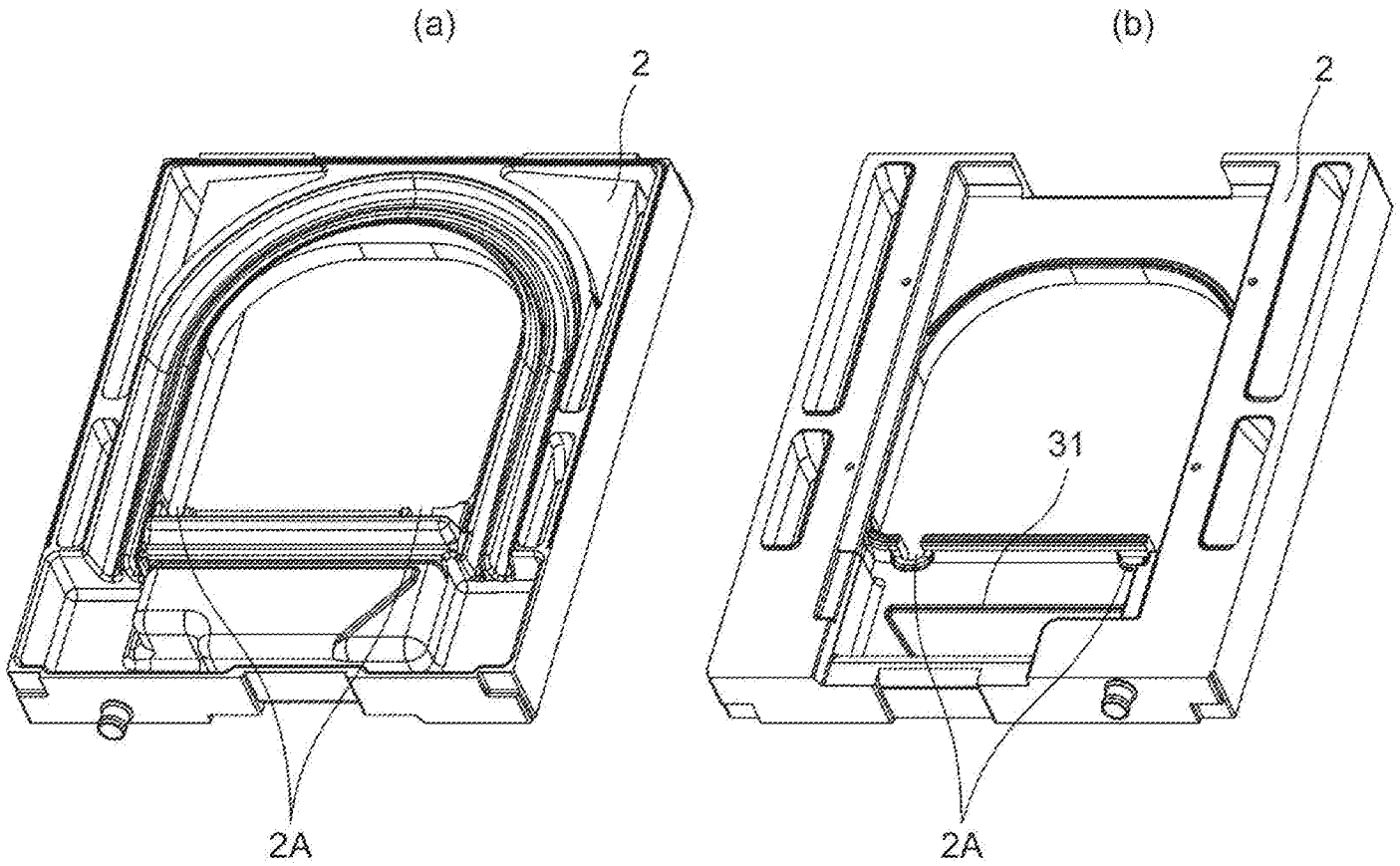
FIGS. 3(*a*) and 3 (*b*) are diagrams showing a drain pan stored in a casing of the air-conditioning indoor unit, where FIG. 3(*a*) is a perspective view as viewed obliquely from above and FIG. 3(*b*) is a perspective view as viewed obliquely from below.
Figure 4:
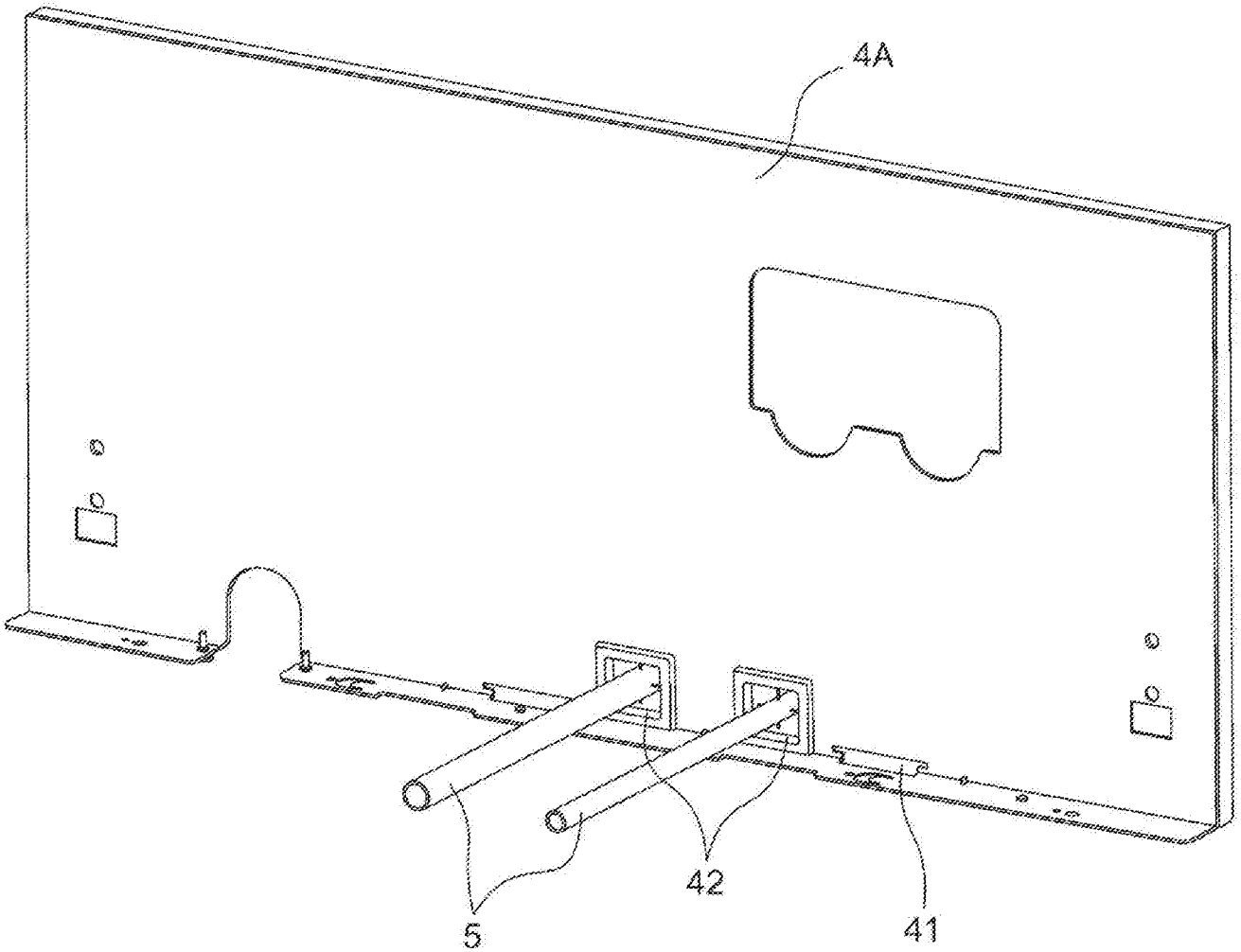
FIG. 4 is an external view showing a side plate of the casing of the air-conditioning indoor unit.
Figure 5:
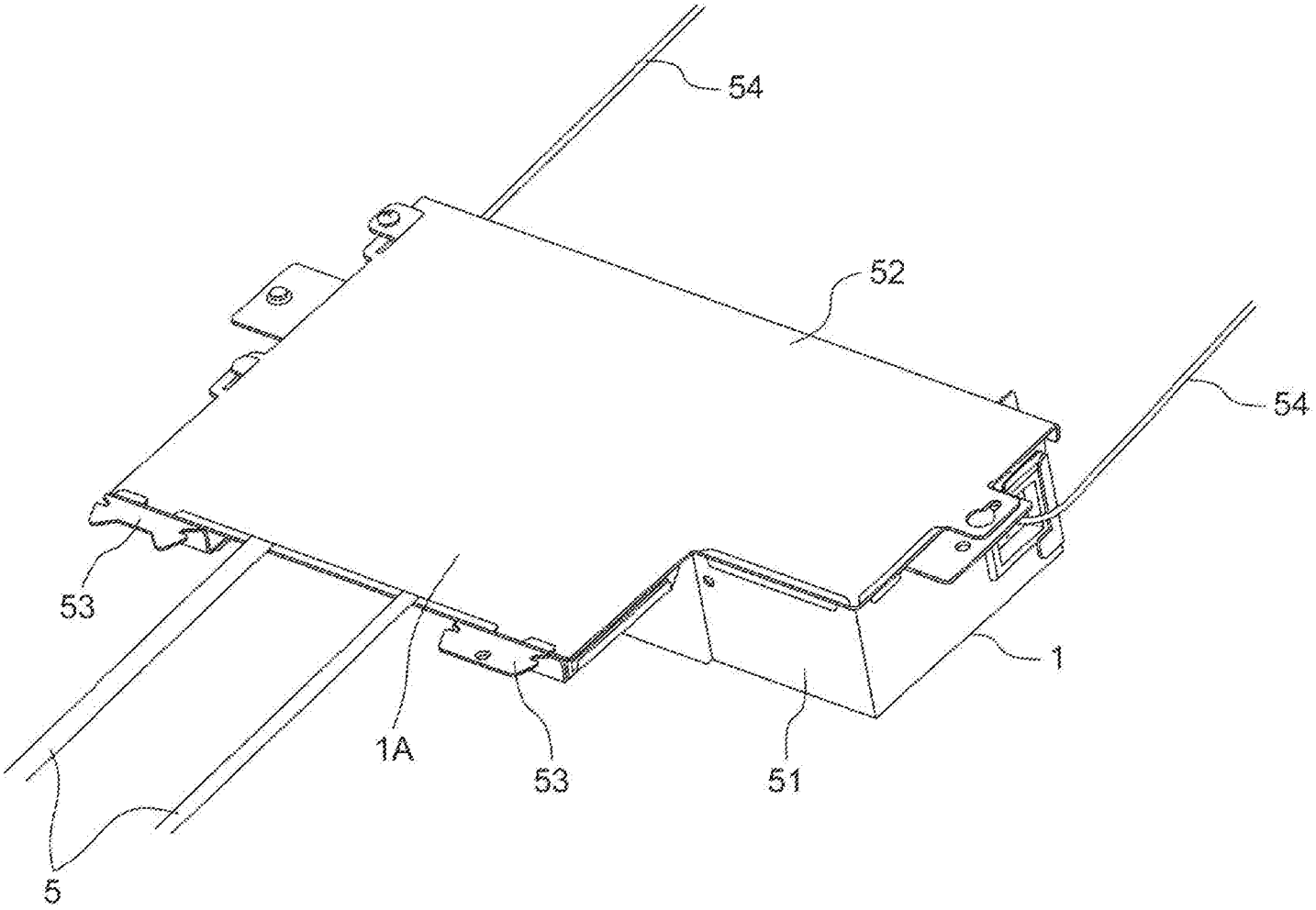
FIG. 5 is a perspective view of a control box of the air-conditioning indoor unit as viewed obliquely from below.
Figure 6:
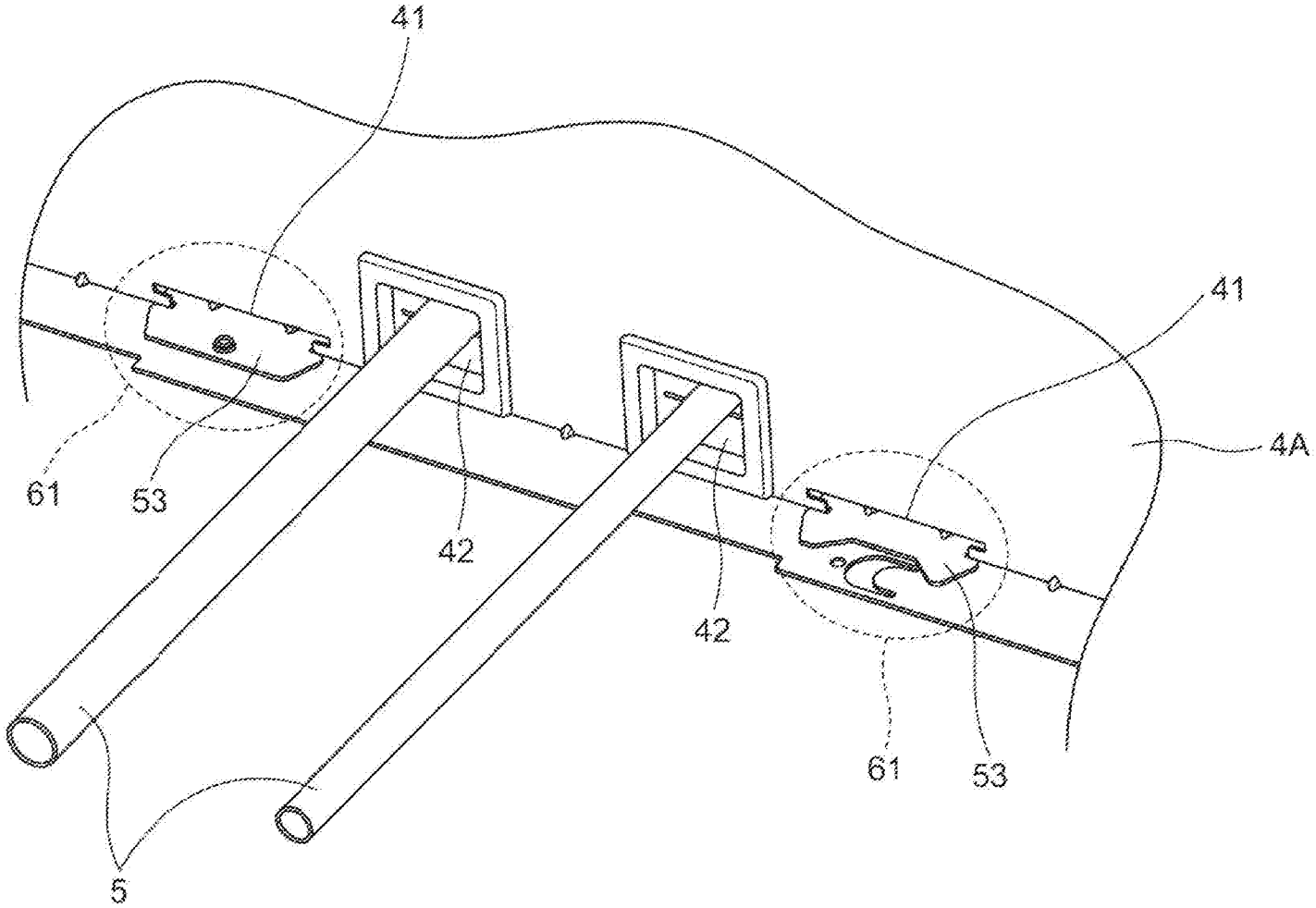
FIG. 6 is a partially enlarged perspective view showing how the control box and the side plate of the casing are connected via a hinge assembly in the air-conditioning indoor unit.
Figure 7:
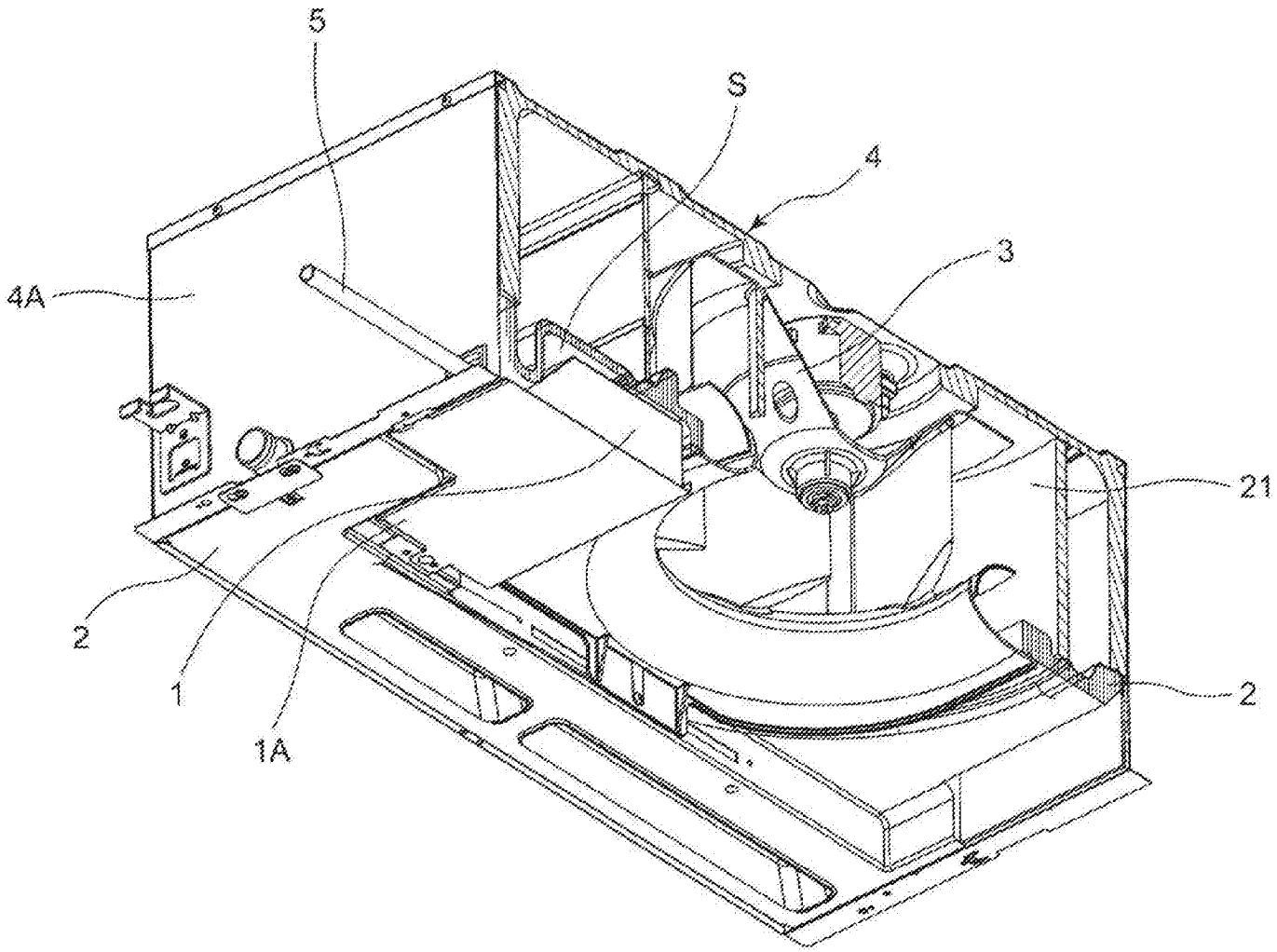
FIG. 7 is a perspective view of the air-conditioning indoor unit including a longitudinal section.

FIG. 1 is an overall external view of an air-conditioning indoor unit of an air-conditioning device according to Embodiment 1 of the present invention as viewed obliquely from below; FIG. 2 is an internal structural diagram of the air-conditioning indoor unit as viewed obliquely from above; FIGS. 3(*a*) and 3 (*b*) are diagrams showing a drain pan stored in a casing of the air-conditioning indoor unit, where FIG. 3(*a*) is a perspective view as viewed obliquely from above and FIG. 3(*b*) is a perspective view as viewed obliquely from below; FIG. 4 is an external view showing a side plate of the casing of the air-conditioning indoor unit; FIG. 5 is a perspective view of a control box of the air-conditioning indoor unit as viewed obliquely from below; FIG. 6 is a partially enlarged perspective view showing how the control box and the side plate of the casing are connected via a hinge assembly in the air-conditioning indoor unit; and FIG. 7 is a perspective view of the air-conditioning indoor unit including a longitudinal section.

In the above drawings, the air-conditioning indoor unit of the air-conditioning device according to Embodiment 1 of the present invention is a ceiling cassette type two-way airflow indoor unit. The indoor unit includes a heat exchanger 21, which is part of a refrigerant circuit including a compressor, an outdoor heat exchanger, and an expansion valve (none is shown); a drain pan 2 installed below the heat exchanger 21; a fan 3 configured to send air to the heat exchanger 21; a control box 1 containing control parts (not shown) configured to control operation of operating equipment such as the fan 3 and the expansion valve; and a casing 4 installed in a mounting opening R (see FIG. 8) in a ceiling T. The heat exchanger 21, drain pan 2, fan 3, and control box 1 are stored in the casing 4 shaped like a rectangular box. A bottom of the casing 4 is formed by being opened as a drain pan inlet-outlet port U. The drain pan inlet-outlet port U is lidded when the drain pan 2 is attached. A hinge assembly 61 is installed on a lower hem of a side plate 4A of the casing 4.

The control box 1 is housed in a control box housing unit 31 located at a position below the drain pan 2 (i.e., in a non-interfering space S free from interference with a water collecting portion 2B formed in the deepest part of the drain pan 2). The drain pan 2 and control box 1 are configured to be taken out downward through the drain pan inlet-outlet port U in the bottom of the casing 4. The hinge assembly 61 and control box 1 are coupled together via engaging claws 53 of the control box 1. A dimension L of a plate 1A is set beforehand to be larger than a height dimension t of the water collecting portion 2B of a drain pan 2 located at a position near the hinge assembly 61 (see FIG. 9). The center of gravity G of the control box 1 is set beforehand such that an opening angle θ of the plate 1A with respect to the drain pan inlet-outlet port U of the casing 4 will be 90 degrees or above when the control box 1 descends under its own weight through the drain pan inlet-outlet port U in the bottom of the casing 4 (see FIG. 10).

With this configuration, a pair of engaging notches 41 is formed at a position near the lower hem of the side plate 4A of the casing 4 as shown in FIG. 4. Also, as shown in FIG. 5, the control box 1 is made up of a control box main body 51 containing the above-mentioned control parts and a control box cover 52 shaped like a flat plate and configured to lid an opening port of the control box main body 51, with an end portion of the control box cover 52 serving as the plate 1A. Then, as shown in FIG. 6, the engaging claws 53 provided on the control box main body 51 are designed to be fitted in and engaged with the engaging notches 41 in the side plate 4A of the casing 4 when the control box 1 is placed in such a posture that the control box cover 52 will be on a bottom side.

The hinge assembly 61 is made up of the pair of engaging notches 41 formed at a position near the lower hem of the side plate 4A of the casing 4 by penetrating therethrough and the pair of engaging claws 53 formed on a front edge of the control box main body 51. The engaging claws 53 are designed to be removably inserted into the engaging notch holes 41 and locked in such a way as to be able to swing up and down. That is, the control box cover 52 and control box main body 51 are fixed with screws and the engaging claws 53 are engaged with the engaging notches 41 in the side plate 4A, thereby coupling the control box 1 to the casing 4.

Next, a method for routing the on-site wiring 5 to the control box 1 will be described. As shown in FIGS. 4 and 6, the on-site wiring 5 is passed through rubber bushings 42 attached to the side plate 4A of the casing 4. Subsequently, as shown in FIG. 5, the on-site wiring 5 is passed through a gap between the control box main body 51 and control box cover 52 of the control box 1, and then connected to a terminal block inside the control box 1. On the other hand, internal wiring 54 is designed to be connected at one end to operating equipment such as the fan 3 and expansion valve (not shown) and connected at another end to the terminal block (not shown) inside the control box, and is laid by being passed through internal wiring passages 2A of the drain pan 2.

Next, operation will be described.

Figure 8:
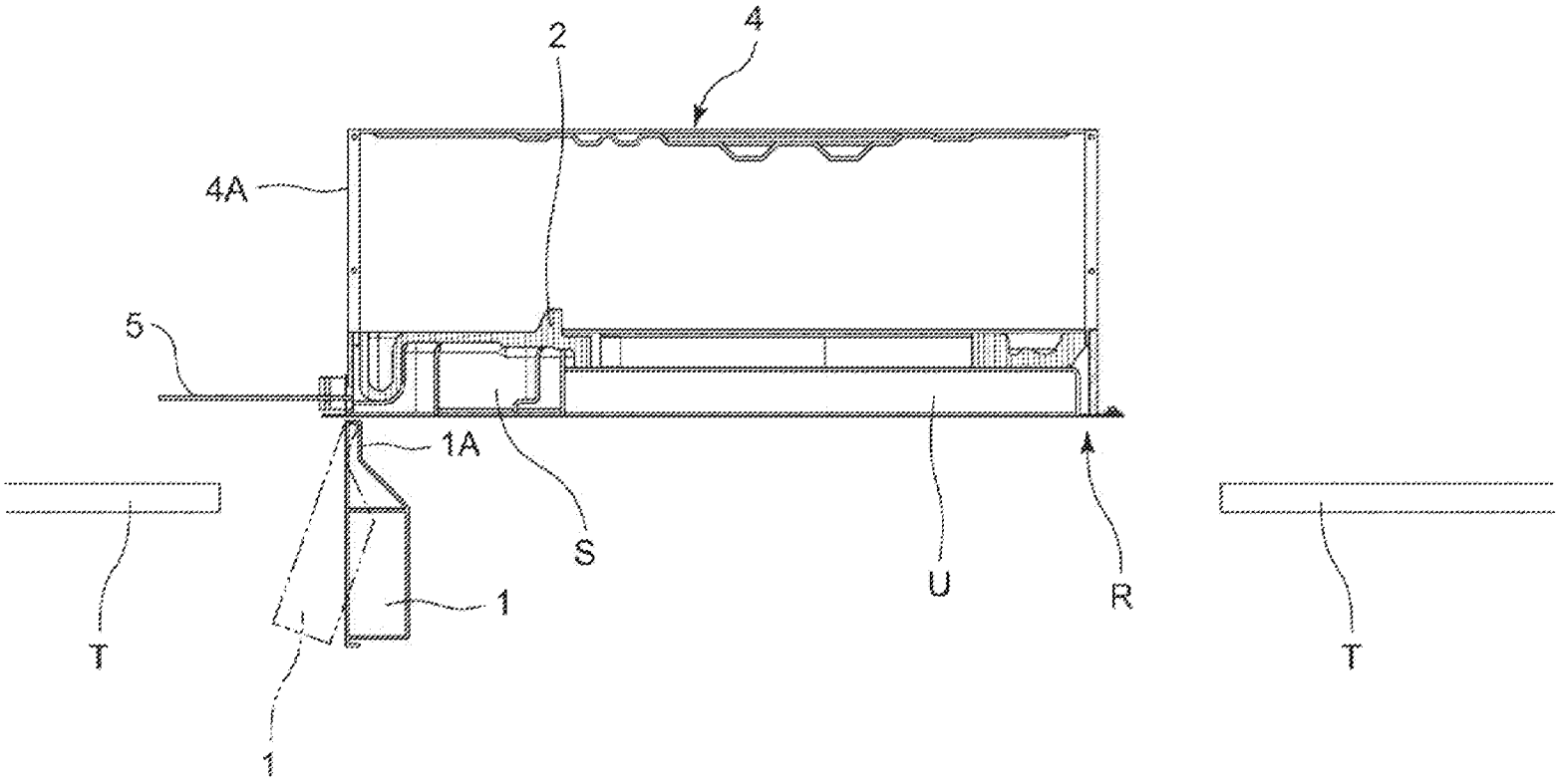
FIG. 8 is a sectional side view showing a state of the control box when engaging claws of the control box are hitched to engaging notches of the side plate in the air-conditioning indoor unit.

With the air-conditioning indoor unit that is configured as described above, in cleaning the drain pan 2, to remove the control box 1 from the drain pan 2, the internal wiring 54 connected to the terminal block inside the control box 1 is removed. Subsequently, screws (not shown) fixing the control box 1 to the drain pan 2 are removed. Even when the screws fixing the control box 1 to the drain pan 2 are removed in this way, the engaging claws 53 of the control box 1 swing up and down using the engaging notches 41 in the side plate 4A as fulcrums, keeping the control box 1 coupled to the side plate 4A and supported in a hanging state as shown in FIG. 8.

As described above, with the air-conditioning indoor unit according to the present embodiment, since the control box 1 is coupled to the casing 4 in such a way as to be able to be taken in and out of the casing 4 via the hinge assembly 61 installed on the lower hem of the side plate 4A of the casing 4, the control box 1 can be stored in a non-interfering space S inside the drain pan inlet-outlet port U in the casing 4 during normal operation and can be taken out of the casing 4 by pivoting on the hinge assembly 61 at a time of inspection and repair. That is, the control box 1 can be taken out of the casing 4 in a coupled state without being separated from the casing. Consequently, in the operation of taking the drain pan 2 out of the drain pan inlet-outlet port U of the casing 4, since there is no need to remove the on-site wiring 5 from the control box 1 and the drain pan removal process can be performed with the control box 1 kept coupled to the side plate 4A of the casing 4, efficiency in the operation of attaching and detaching the drain pan 2 can be improved.

Figure 9:
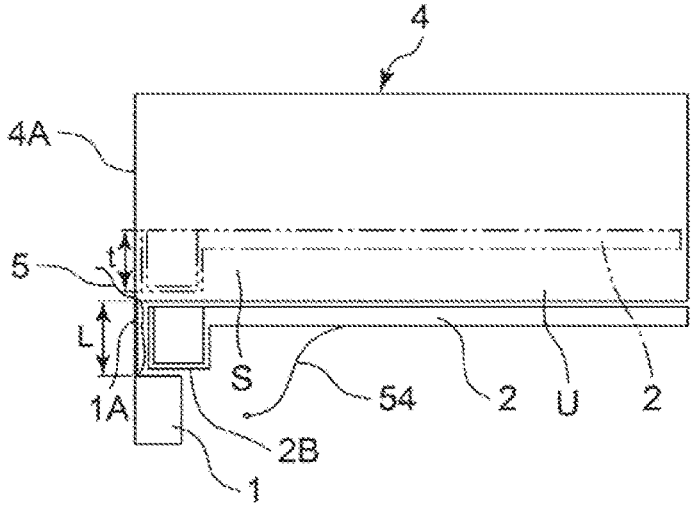
FIG. 9 is a sectional side view showing a state of the control box when the drain pan is taken out of the casing through the drain pan inlet-outlet port in the air-conditioning indoor unit.

Also, since the dimension L of the hinge assembly 61 and plate 1A of the control box 1 is set larger than the height dimension t of the water collecting portion 2B of the drain pan 2 located at a position near the hinge assembly 61, even if the drain pan 2 is taken out downward through the drain pan inlet-outlet port U as shown in FIG. 9, after the control box 1 is taken out downward by opening the plate 1A around the hinge assembly 61, the water collecting portion 2B does not abut and interfere with the control box 1, and thus the drain pan 2 can be taken in and out of the drain pan inlet-outlet port without hindrance.

Figure 10:
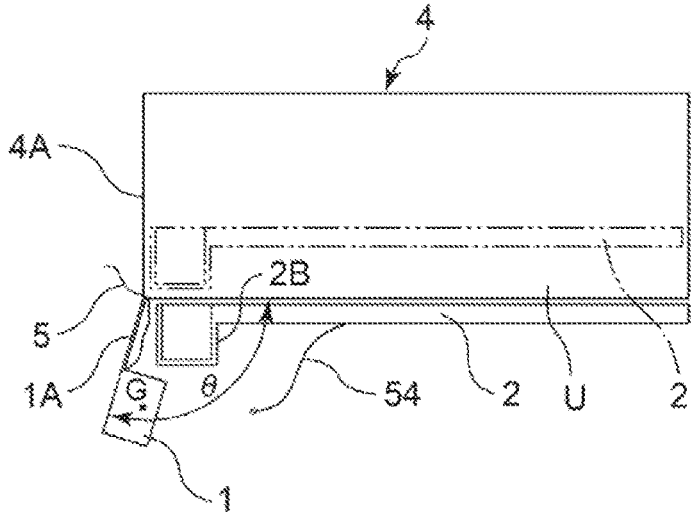
FIG. 10 is a sectional side view showing a tilt angle state of the control box when the drain pan is taken out of the casing through the drain pan inlet-outlet port in the air-conditioning indoor unit.

Then, since the center of gravity G of the control box 1 is set in a predetermined manner, when the control box 1 is taken out downward, the plate 1A opens at an angle of 90 degrees or above with respect to the drain pan inlet-outlet port U under its own weight of the control box 1 as shown in FIG. 10, making it possible to further prevent interference between water collecting portion 2B and control box 1 and take the drain pan 2 in and out extremely easily.

Furthermore, since the hinge assembly 61 is made up of the engaging notches 41 of the side plate 4A and the detachable engaging claws 53, the control box 1 can be removed from the casing 4 as needed, increasing applicability during inspection and repair. Also, the engaging notches 41 and engaging claws 53, which can be produced easily by punching metal sheets without the need for separate parts, can be provided at low costs.

Note that even when the control box 1 is taken out of the drain pan inlet-outlet port U of the casing 4 as described above, the on-site wiring 5 connected to the control box 1 is held beforehand by a wire holder 6 provided in the control box 1 and is free of trouble caused by tension exerted on the on-site wiring 5.

Figure 11:
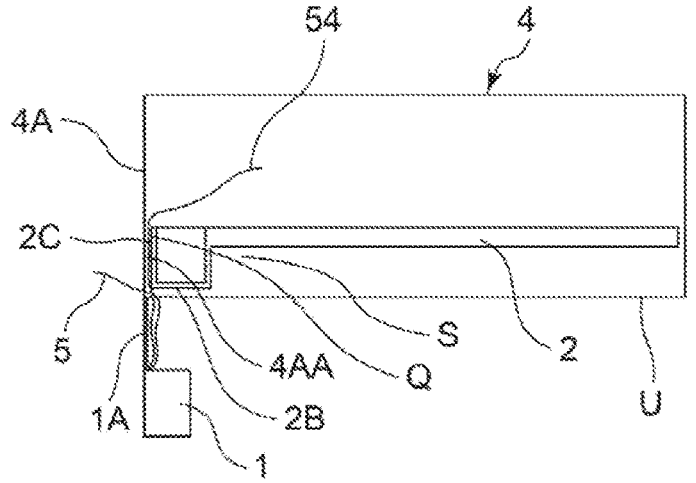
FIG. 11 is a sectional side view showing how internal wiring is passed between an inner surface of the side plate and outer surface of the drain pan with the control box being gotten out in the air-conditioning indoor unit.

Here, as shown in FIGS. 9 and 10, the internal wiring 54 is connected to the control box 1 from the bottom side of the drain pan 2, but as shown in FIG. 11, the internal wiring 54 may be connected to the terminal block inside the control box 1 by being passed between a lateral surface 2C of the drain pan 2 and an internal surface 4AA of the side plate 4A and by being passed further through the gap between the control box main body 51 and control box cover 52 as with the on-site wiring 5. This configuration makes it possible to take the drain pan 2 out of the casing 4 without removing the internal wiring 54 and on-site wiring 5 from the control box 1.

Note that although in the above embodiment the hinge assembly made up of the engaging notches 41 in the casing 4 and the engaging claws 53 on the plate 1A has been described as an example, the present invention is not limited to this. For example, while installing an equivalent for the engaging claws 53 in such a way as to protrude from the lower hem of the casing 4, an equivalent for the engaging notches 41 may be formed on a front edge of the plate 1A to engage with the engaging-claw 53 equivalent, and a set of the engaging-claw equivalent and engaging-notch equivalent may be used as a hinge assembly. Alternatively, as the hinge assembly of the present invention, general-purpose hinges can be used.

REFERENCE SIGNS LIST

1 control box 1A plate 2 drain pan 2A internal wiring passage
2B water collecting portion 2C lateral surface 3 fan 4 casing
4A side plate 4AA internal surface 5 on-site wiring 6 wire holder
21 heat exchanger 31 control box housing unit 41 engaging notch
42 rubber bushing 51 control box main body 52 control box cover
53 engaging claw 54 internal wiring 61 hinge assembly L dimension Q gap R mounting opening S non-interfering space t height dimension T ceiling U drain pan inlet-outlet port θ opening angle

The invention claimed is:

1. An air-conditioning indoor unit comprising:
a heat exchanger;
a fan configured to send air to the heat exchanger;
a drain pan installed below the heat exchanger and provided with a water collecting portion protruding on a bottom of the drain pan;
a control box installed on the bottom of the drain pan; and
a casing in which a drain pan inlet-outlet port opening is formed, wherein
the drain pan inlet-outlet port is formed on a bottom of the casing,
the casing is configured to store the heat exchanger, the fan, the drain pan, and the control box,
the control box includes
a control box main body,
a control box cover configured to lid the control box main body, and
a plate that extends from the control box cover towards a side plate forming the casing,
the control box is stored at a position adjacent to the water collecting portion of the drain pan of which the drain pan inlet-outlet port is lidded,
the control box is connected to the casing via a hinge assembly on the side plate, and
a dimension of the plate from the control box to the side plate is greater than a height dimension of the water collecting portion of the drain pan.

2. The air-conditioning indoor unit of claim 1, wherein
the hinge assembly is located on a lower part of the side plate of the casing,
the control box is stored in a non-interfering space, which is free from interference with the drain pan by being located at a position below the drain pan and is configured to be taken out downward through the drain pan inlet-outlet port, and
the hinge assembly and the control box are coupled together via an engaging claw.

3. The air-conditioning indoor unit of claim 2, wherein a center of gravity of the control box is set such that an opening angle between the plate and the drain pan inlet-outlet port is 90 degrees or more when the control box descends under its own weight through the inlet-outlet port.

4. The air-conditioning indoor unit of claim 2, wherein
the hinge assembly includes an engaging notch formed in the side plate,
the engaging claw protrudes from the control box, and
the engaging claw is removably inserted into the engaging, notch and is restrained such that the control box can pivot with respect to the side plate.

5. The air-conditioning indoor unit of claim 1, wherein internal wiring, which is connected at one end to the fan and connected at another end to the control box, is passed through a gap between a lateral surface of the drain pan and an inner surface of the side plate of the casing.

6. The air-conditioning indoor unit of claim 1, wherein an on-site wiring from outside the indoor unit is connected to the control box,
the on-site wiring passes through the side plate, and the on-site wiring is wired such that the on-site wiring passes through a gap between the control box cover and the control box main body.

7. The air-conditioning indoor unit of claim 1, wherein the hinge assembly includes an engaging notch formed at a lower part of the side plate by penetrating therethrough, and an engaging claw provided at an end of the plate, and protruding from the plate, the engaging claw being configured to removably inserted into the engaging notch, and the hinge assembly locks the control box such that the control box can pivot with respect to the side plate of the casing using the hinge assembly as a fulcrum.

8. The air-conditioning indoor unit of claim 1, wherein the control box and the drain pan are coupled to each other.

9. The air-conditioning indoor unit of claim 1, wherein the control box cover forms a bottom surface of the control box of the main body, and the plate extends from the control box main body.

10. The air-conditioning indoor unit of claim 1, wherein the control box main body is spaced apart from the side plate, the water-collecting portion is located between the side plate and the control box main body, the control box cover forms a bottom surface of the control box main body, and the plate extends from the control box main body.

* * * * *